United States Patent [19]

Stevens et al.

[11] Patent Number: 4,971,511

[45] Date of Patent: Nov. 20, 1990

[54] VEHICLE LIFTING DEVICE

[76] Inventors: Michael E. Stevens, 2294 W. 8120 South, West Jordan, Utah 84084; Edward W. Stevens, 2445 W. Bueno Vista Dr., West Jordan, Utah 84088

[21] Appl. No.: 27,855

[22] Filed: Mar. 19, 1987

[51] Int. Cl.[5] ..... B66F 7/22

[52] U.S. Cl. ..... 414/678; 187/8.71; 254/127; 254/3 B

[58] Field of Search ..... 414/678; 254/3 R, 3 B, 254/3 C, 4 R, 4 B, 4 C, 5 B, 127; 187/8.41, 8.71, 23, 27

[56] References Cited

U.S. PATENT DOCUMENTS

| | | | |
|---|---|---|---|
| 745,545 | 12/1093 | Webb | 254/88 |
| 1,314,357 | 8/1919 | Olson | 254/127 |
| 1,436,766 | 11/1922 | Kendrick | 187/8.41 X |
| 1,478,256 | 12/1923 | Reid | 414/678 |
| 1,585,559 | 5/1926 | Philip | 254/3 R X |
| 1,831,475 | 11/1931 | Beal | 254/3 R |
| 3,252,590 | 5/1966 | Nielsen | 414/678 |
| 3,838,783 | 10/1974 | Tune | 414/577 |
| 4,238,959 | 12/1980 | McCann | 187/8.41 X |
| 4,579,505 | 4/1986 | Lauritsen | 414/678 |
| 4,594,048 | 6/1986 | Sipla | 414/678 |

FOREIGN PATENT DOCUMENTS

| | | | |
|---|---|---|---|
| 206791 | 9/1955 | Australia . | |
| 755552 | 2/1971 | Belgium . | |
| 113673 | 4/1969 | Denmark | 414/678 |
| 1129868 | 10/1956 | France . | |
| 84/04503 | 11/1984 | Int'l Pat. Institute . | |
| 431294 | 8/1967 | Switzerland . | |
| 598974 | 12/1977 | Switzerland . | |
| 765202 | 9/1980 | U.S.S.R. | 254/3 R |
| 661558 | 11/1951 | United Kingdom | 414/678 |
| 1373935 | 11/1974 | United Kingdom . | |

*Primary Examiner*—Robert J. Spar
*Assistant Examiner*—James T. Eller, Jr.
*Attorney, Agent, or Firm*—Thorpe, North & Western

[57] ABSTRACT

A system for lifting and tilting a vehicle sideways is disclosed. The system includes a hoist having a base shaft, a lifting shaft pivotedly mounted at its end to the base shaft, and a mast shaft which is likewise pivotedly mounted at its end to the base shaft. An arrangement of pulleys is positioned on the mast shaft and lifting shaft. A cable connects the pulleys and provides a mechanical advantage lifting system for raising the lifting shafts under the power of a power driven winch.

11 Claims, 5 Drawing Sheets

VEHICLE LIFTING DEVICE

BACKGROUND OF THE INVENTION

1. Field:

This invention is directed to a system adapted for lifting and tilting a vehicle sideways for purposes of accessing to the undercarriage of the vehicle. More particularly, the invention relates to a hoist and bearer arrangement suited for such lifting and tilting.

2. State of the Art:

Due to their construction, many automobiles, trucks and similar vehicles require maintenance and servicing to be performed from beneath the vehicle. For example, the replacement of a muffler, the draining of an oil pan, and the draining of the radiator all require the mechanic to position himself below the vehicle in order to service the vehicle. Given the low ground clearance of many conventional vehicles, oftentimes the mechanic is physically precluded from sliding under the vehicle. Further, the undercarriage of a vehicle is generally covered with dirt, oil, tar and similar other contaminants. If the mechanic is able to slide under the vehicle, typically he is soiled by coming into contact with the undercarriage. Moreover, in many work operations the mechanic must look upward into the vehicle in order to properly service the vehicle. This requirement endangers the mechanic in that dirt, oil or other foreign substances may fall into the mechanic's eyes.

In those situations where there is considerable vehicle ground clearance, many mechanics use a device known as a crawler. This device is essentially a flat bed having multi-directionable wheels affixed thereto. The wheels permit the mechanic considerable flexibility in maneuvering himself below the vehicle from location to location as the need arises. Though the crawler alleviates the necessity of the mechanic's sliding on his back over the ground as he moves beneath the vehicle, the crawler doesn't totally eliminate the dangers of foreign particles falling into the mechanic's eyes.

In order to afford the mechanic a less restricted working environment beneath the vehicle, alternate approaches involve the actual lifting or elevation of the vehicle itself. The most prominent device of this type is the common car jack. Other constructions which effect a similar function are those disclosed in U.S. Pat. No. 3,838,783 (Tune) and U.S. Pat. No. 745,545 (Webb). Both of these latter devices permit the mechanic to raise the rear end of the vehicle for purposes of better access to the vehicle's undercarriage.

Alternatively, other disclosures suggest a means of lifting and tilting a vehicle sideways Ultimately, the vehicle is positioned on its side thereby exposing the undercarriage for servicing. U.S. Pat. No. 1,288,738 (Nicoson) discloses a pair of "U"-shaped cradles suited for retaining a vehicle therebetween. The cradles are mounted on rollers which facilitate a rotation of the cradles whereby the vehicle is turned onto its side. U.S. Pat. No. 1,334,336 (Weimar) discloses a vehicle retaining frame structure having a curved sidewall. The frame is connected to an arm-held, variable weight member. Upon the member obtaining a given weight, the frame is displaced over onto its side, thereby orienting the vehicle on its side. Another vehicle tilting apparatus is that shown in U.S. Pat. No. 1,585,559 (Philip).

Within the last few years attention has been directed to a variety of vehicle "tumbler" structures. In brief, these structures include an arc-shaped bearer which is releasably mounted to the hubs of a vehicle, on one side of that vehicle. A force is then typically applied to the opposing side of the vehicle resulting in the vehicle's being rolled onto its side owing to the configuration and orientation of the bearers. Representative of devices of this construction are those disclosed in U.S. Pat. Nos. 3,674,252 (Crabtree); 4,579,505 (Lauritsen); and 4,594,048 (Sipla). Typically, the mechanic must manually push the vehicle over onto its side such that the bearers support the vehicle.

SUMMARY OF THE INVENTION

The lifting and tilting system of the invention includes generally a novel hoist which is made mechanically cooperable with a pair of interconnected cradle bearers. The cradle bearers operate to facilitate the rotation of the vehicle onto its side upon a force being applied to the undercarriage of the vehicle by the hoist.

The hoist includes a first elongate shaft having a proximal and distal end. This first shaft serves as a base for the hoist and extends along the ground. For typical operation the first shaft is positioned on the ground beneath the vehicle such that its longitudinal axis is oriented transverse to the longitudinal axis of the vehicle. Most commonly, the first shaft is positioned between the front and rear wheels of the vehicle. The shaft is stabilized against any rotative motion by a support means. This support means may be an elongate panel affixed to the distal end of the first shaft, generally orthogonally to the longitudinal axis of the first shaft.

A second elongate shaft is pivotedly connected at its proximal end to the first shaft at the proximal end of the latter shaft. This second shaft is adapted to rotate about its pivot in a generally vertical, upright plane. This second shaft is adapted for abutment against the undercarriage of a vehicle whereby a forced, rotative displacement of the second shaft applies a sideways lifting and tilting force to the vehicle. In some embodiments, the second shaft is fitted with an adjustable receiving member which is suitably configured to embrace the vehicle's undercarriage. This receiving member stabilizes the force application against the undercarriage by the second shaft as against lateral displacements. Preferably, this receiving member includes an abutment surface having a high coefficient of friction.

The hoist and particularly the second shaft include a connection means for connecting the second shaft and hence the hoist to a plurality of cradle-type bearers mounted on the vehicle's wheels. This connection means operates to minimize any displacement of the first shaft along a direction parallel to the longitudinal axis of that first shaft.

A third elongate shaft having a proximal and a distal end is pivotedly mounted at its proximal end to the distal end of the first shaft. The third shaft is rotatable in a generally upright, vertical plane about its pivot.

The distal end of the second shaft abuts against the surface of the third shaft. During the operation of the hoist, the second shaft distal end may travel in a reciprocal path along the length of the third shaft between the proximal and distal end of the third shaft. In preferred embodiments, a guide means is associated with the second shaft's distal end for minimizing any lateral displacement of that second shaft which may remove the second shaft from its abutting relationship with the third shaft. The term "lateral" in this context is defined as any direction which is transverse to the vertical plane of rotation of the second shaft. Further, the distal end of the second shaft may be fitted with a roller rotatably mounted on that shaft, e.g., in bearings.

The roller contacts the surface of the third shaft and rolls along that surface as the second shaft and third shaft are displaced vis-a-vis each other. The roller operates to minimize drag, e.g., friction between the two shafts.

A plurality of pulleys are associated with the second and third shafts. The cable being associated with those pulleys in a particular orientation and scheme, facilitates a mechanical advantage-ladened force application to the second shaft. In one construction, a first pulley and a second pulley are mounted on the distal end of the third shaft. A third pulley and a fourth pulley are mounted on the distal end of the second shaft. A fifth pulley is mounted on the proximal end of the second shaft. In preferred constructions, the pulleys are rotatably mounted.

A drive means, e.g., a winch, is mounted on the third shaft. This drive means is fitted with a cable having a first end which is mounted to the drive means. The cable extends outwardly from the drive means, eventually terminating in a second end.

In extending from the drive means, the cable first extends to and passes over the first pulley. Thereafter, it extends to and passes over the third pulley. From the third pulley, the cable extends to and passes over the fifth pulley, thereafter the cable extends to and passes over the fourth pulley. From the fourth pulley the cable extends to and passes over the second pulley. Thereafter, the cable extends to its second end which is fixedly affixed to the hoist, preferably to the third shaft.

As the cable is drawn toward the drive means by the operation of that drive means, e.g., as it is successively wrapped around the drum of the winch, the cable effects a generally vertical rotation of the second shaft around its pivot. Initially, the third shaft is oriented generally vertically, i.e., upright. As the cable is drawn up on the drive means, the second shaft, which initially was oriented generally horizontally, is rotated causing its distal end to be elevated. As the second shaft's distal end proceeds along the length of the third shaft, the angle between the longitudinal axis of the second shaft and the horizontal increases progressively. The third shaft in contrast begins to rotate progressively from a generally upright orientation toward the horizontal, i.e., the angle between the longitudinal axis of the third shaft and the horizontal increases between 90° and 180°. The angle measures are determined counterclockwise using the horizontal as the initial reference point.

In preferred constructions, the hoist is associated with a pair of cradle-type bearers. Each of these bearers include a first section having a perimeter presenting a generally arcuate configuration. This arcuate portion of the perimeter forms a contact surface between the ground and the bearer so that the bearer may rotate with the vehicle to which it is mounted. This first section is mounted to the wheel or hub of the vehicle by a mounting means. In some constructions, this mounting means may include a plurality of rods having recess wells on the ends thereof. Each of these recess wells are fitted with interior or female threads dimensioned to mechanically cooperate with the lug bolts of the vehicle. Upon securing the rods to the lug bolts, a mounting plate is positioned to receive the opposing, non-mounted ends of the rods. The plate is suitably adapted to form a union with the rods. In one embodiment, each of the rods include a shoulder portion spacedly mounted from the free end of the rod. Upon the free end of the rod being inserted through an aperture in the plate, the shoulder is brought into abutment against the plate. A bolt having a head is then threadingly inserted into the threads defined within the free end, bringing the head into an abutment against the plate. The plate is thus held sandwiched between the shoulder and the bolt head.

The plate is received within slots defined by the first section, forming thereby a detachable mounting of the first section to the wheel or hub of the vehicle. The first section is connected to a second structural section which may be an elongate shaft.

A bearer is mounted on at least two wheels or hubs of a vehicle on the same side of the vehicle. As mounted, the bearers generally extend upright and outwardly from the vehicle. Typically, the plane of the bearer is mounted orthogonal to the longitudinal axis of the vehicle. A tie rod may be mounted between each pair of bearers so as to maintain the bearers in a parallel orientation vis-a-vis each other.

Preferably, a support member extends between each pair of bearers. In preferred embodiments, the support may be an elongate shaft which is slidingly mounted in openings defined within each bearer. This support member constitutes a mounting platform for the connection means described above.

Many bearer structures are employable with the hoist of the instant invention, e.g., the bearer structures defined in U.S. Pat. No. 3,674,252 (Crabtree) and in U.S. Pat. No. 4,594,048 (Sipla). The specifications of the Crabtree and Sipla patents are hereby incorporated herein by reference.

DETAILED DESCRIPTION OF THE DRAWINGS

The invention is principally directed toward a novel hoist structure adapted for lifting and tilting vehicles. Also included within the scope of the invention is the hoist in association with cradle-type or "tumbler" bearers which facilitate a sideways tilting of a vehicle.

Figure 1:
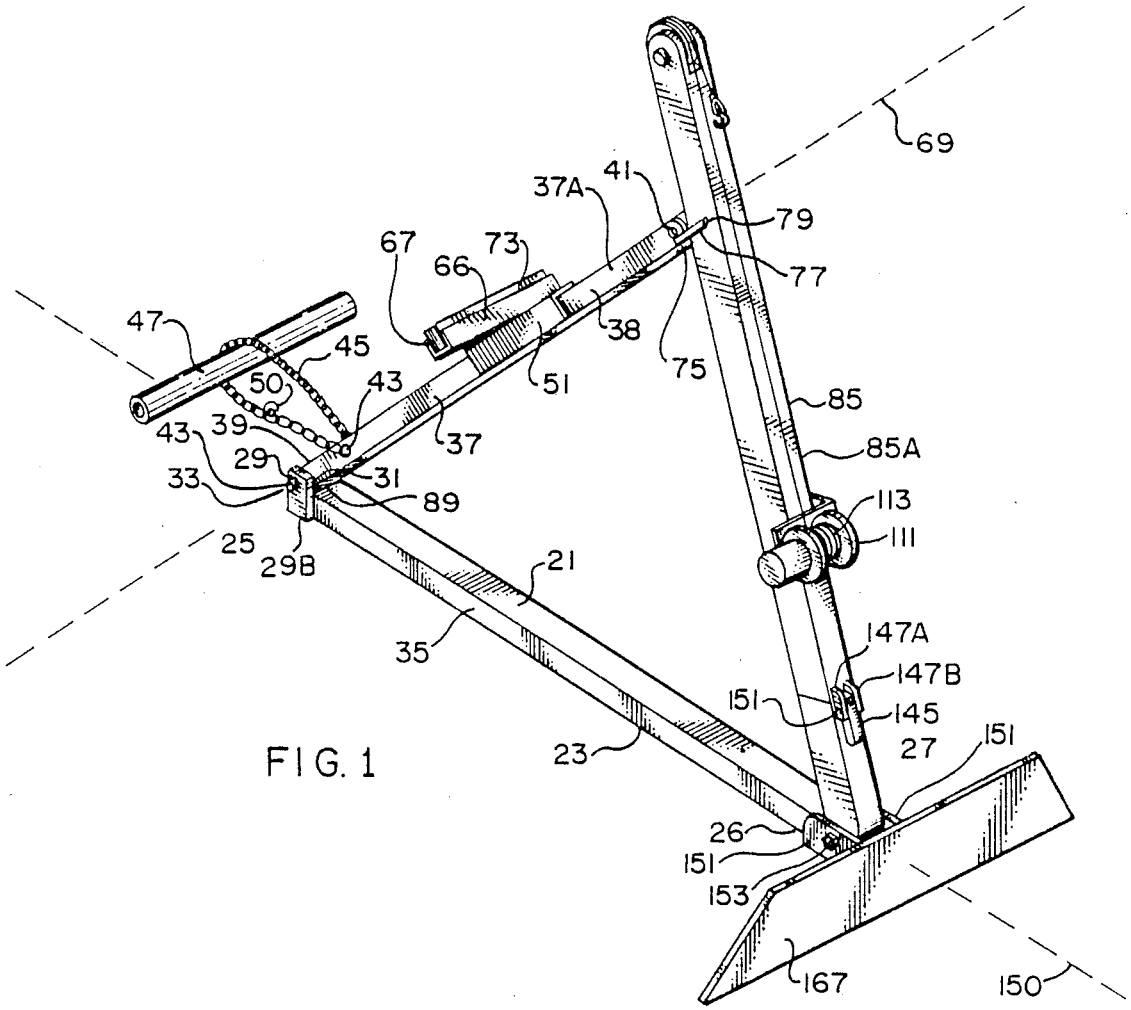
FIG. 1 :s an elevational perspective view of a hoist of this invention in a raised lifting orientation.

As shown in FIG. 1, a hoist of the invention includes an elongate base shaft 21 which has a bottom planar surface 23 for placement on a level or planar ground surface. The bottom surface 23 may be textured or roughened to retard slippage along the ground. Alternately, a material having a high coefficient of friction may be applied to the bottom surface. Rubber or a similar synthetic material are contemplated for this purpose. The base shaft may be quadrilateral in cross section, though other configurations are readily adaptable for the purposes of the invention. Base shaft 21 has a proximal end 25 and an opposing distal end 27.

Mounted on first end 25 is a pair of upstanding vertical ears 29. Ears 29 are elongated, quadrilaterally cross-sectioned panels. Each ear defines an aperture 31 therein dimensioned to receive a pivot bolt 33. The ears 29 are positioned spacedly apart from one another on opposing sides 35 of the shaft 21. In being so spaced, the ears 29 define a channel therebetween through which passes a lifting shaft 37.

Shaft 37 is an elongate shaft having a generally quadrilateral cross section which remains constant over its length. The exterior of shaft 37 defines four planar sides 38. Shaft 37 includes a proximal end 39 and a distal end 41. Proximate end 39 is fitted into the channel between ears 29. Proximate end 39, an elongate channel is defined within shaft 37. The channel is dimensioned to slidably receive and retain a pivot bolt 43. Bolt 43 has a head and extends initially through ear 29A, subsequently passing through the channel in shaft 37 and thereafter through ear 29B. Thereafter, a nut is threaded onto the bolt. The bolt is releasably retained in its mounting and functions as a pivot pin defining a pivot axis for shafts 21 and 37.

Figure 4:
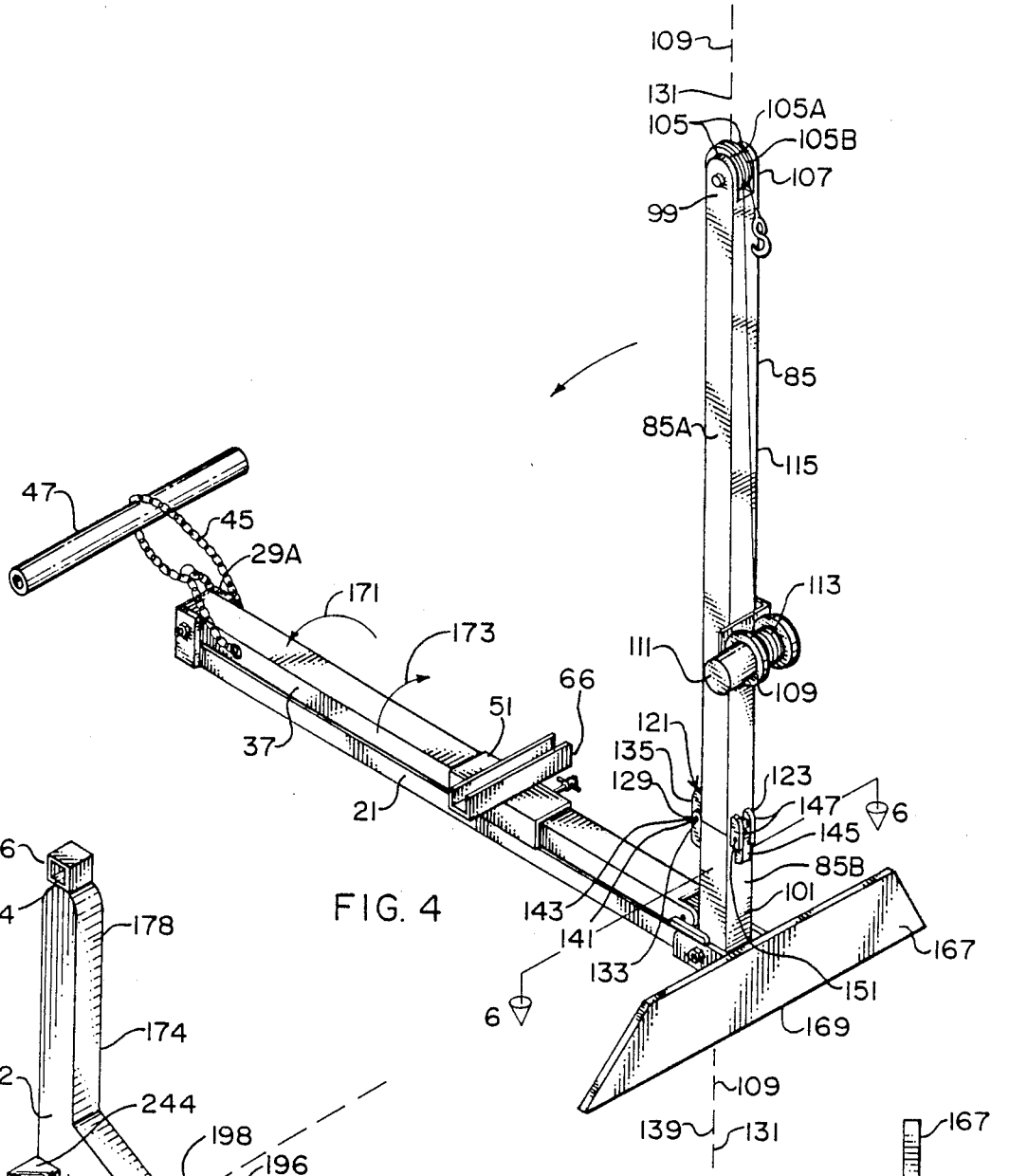
FIG. 4 is an elevational perspective view of the hoist of the invention in a lowered orientation.

Shaft 37 defines a second channel 44 which extends through the width of the shaft. As shown in FIGS. 1 and 4, channel 48 is defined at a distance from the end 39. An elongate chain 45 is passed through the channel 44. Chain 45 has two free ends which may be passed around a support 47. The two ends of the chain 45 are releasably joined together by a lock, clasp or other connection means 50. The endless chain 45 formed by the union of the two free ends operates to link the chain 45 to the support 47. This linkage minimizes and substantial retards any displacement of the hoist in a direction parallel to the longitudinal axis 49 of shaft 21. Other means of linking the shaft 37 to the support 47 are also within contemplation. One of these means may include a hook or plurality of hooks mounted on shaft 37 adapted to form a manually releasable union with the support 47. It should be understood that this linking means may also be mounted on shaft 21 as well as shaft 37.

Figure 2:
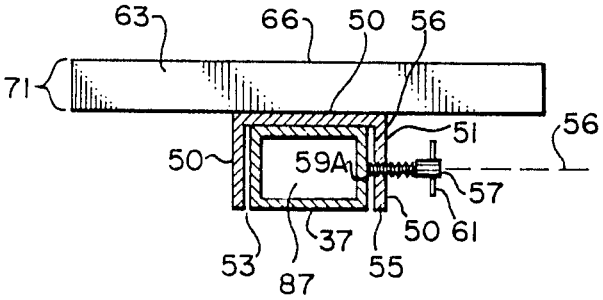
FIG. 2 is a cross-sectional view of an adjustable abutment carriage of the hoist of the invention.

Slidably mounted on the shaft 37 is an abutment or contact trolley 51. As depicted in FIGS. 1, 2 and 4, trolley 51 includes a generally inverted "U"-shaped mounting composed of the union of three planar panels 50. Trolley 51 defines an "U"-shaped channel 53 which is open from below. Channel 53 is dimensioned to slidably receive shaft 37 whereby the trolley 51 may slide along the length of the shaft 37. One of the sidewall panels 50, specifically panel 55, includes a threaded aperture 56 therein dimensioned to threadingly receive a threaded retention bolt 57. Bolt 57 is insertable into aperture 56 sufficiently to contact the sidewall 59A of shaft 37 and thus provides a means of releasably retaining the trolley in a set position along shaft 37. As shown in FIG. 2, the head 54 of bolt 57 may be shaped to assist the user in grasping and turning the bolt by providing a shaft 61 which extends orthogonal to the longitudinal axis 56 of the bolt 57.

Mounted atop the trolley 51 is a contact plate 63. The plate 63 may include a "U"-shaped structure 66 defining a channel 67. Channel 67 is oriented transverse to the longitudinal axis 69 of shaft 37. In particular, the "U"-shaped structure 66 and channel 67 may be oriented orthogonal to the longitudinal axis 69. In other constructions, the channel 67 may be oriented parallel to the axis 69.

The structure 66 functions as a contact or abutment surface between the lifting shaft 37 and the undercarriage or bottom of the vehicle to be lifted. Therefore, the shape and configuration of the structure is adapted to relate with that undercarriage to form a secure non-sliding contact. The width or depth 71 of the channel 67 may be dimensioned to slidably receive a section of the vehicle's frame or undercarriage 72. Alternatively, the user may place a filler insert 73 into the channel 67. The insert 73 is preferably fabricated of a material having a high coefficient of friction, e.g., wood or rubber. As the insert 73 abuts against the undercarriage, the friction between the insert and the undercarriage 72 is relied upon to retain the trolley 51 in position against the undercarriage 72 and preclude the trolley 51 from sliding along the undercarriage.

Mounted on the distal end 75 of shaft 37 is a guide means 77. These guides 77 include a pair of outwardly extending elongate shafts 79. As shown, shafts 79 are positioned on opposing sidewalls 59A and 59B of shaft 37. The shafts 79 extend parallel to the longitudinal axis 69 of shaft 37 and define a channel 83 therebetween. The channel 83 is dimensioned to slidably receive a mast shaft 85.

As shown in FIG. 2, shaft 37 is hollow and defines a generally square cross-sectioned channel 87 which extends the full length of the shaft 37. This channel 87 communicates with the environment through the access ports 89 and 91. Port 89 is defined at the proximal end 39 of shaft 37, which port 91 is defined at the opposing distal end 41. Mounted within port 89 is a circular pulley 93 having an annular "U"-shaped track defined about its circumference. Pulley 93 is preferably rotatably mounted within port 89. Further, the pulley 93 may be mounted on bolt 43 so as to be rotatable about that bolt, i.e., the shaft of the bolt is the axis of rotation of the pulley 93. The axis of rotation is oriented horizontal and orthgonal to the longitudinal axis of shaft 37.

Mounted on the distal end of shaft 37 is a pair of circular pulleys 95, generally identified individually as 95A and 95B. The pulleys are mounted upright with their axis of rotation being horizontally oriented and perpendicular to the longitudinal axis 69 of shaft 37.

Figure 6:
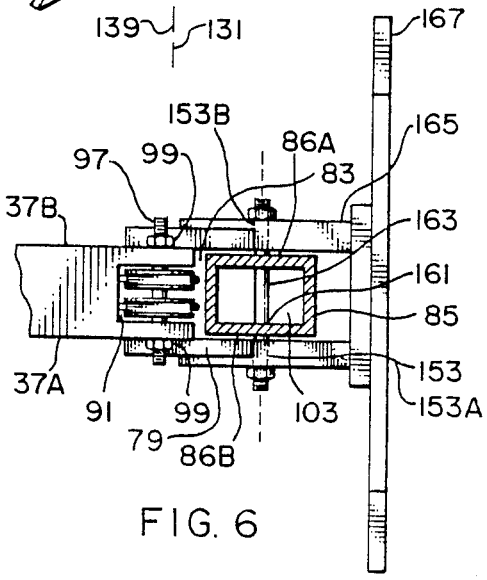
FIG. 6 is a top view in cross section of the mast portion of the hoist of this invention as taken along section lines 6—6 of FIG. 4.

As shown in FIG. 6, pulleys 95 may be mounted on an elongate shaft 97 which initially passes through an aperture in the sidewall 37A of shaft 37, and then through the pulleys 95A and 95B. Subsequently, the shaft 97 exits through an aperture in the sidewall 59B of shaft 37. The shaft 97 is retained in position by suitable structure affixed to the ends of that shaft, e.g., a threaded nut 99. The shaft 97 may have threads on each of its ends configured to thread with nuts 99.

Pulleys 95 each include an annular "U"-shaped track configured within its circumference suitable for receiving and retaining a cable.

Mast shaft 85 is an elongate shaft having a quadrilateral cross section. Similar to shafts 37 and 21, shaft 85 is constituted of four planar panels connected to one another to form an elongate, hollow box-like structure. Shaft 85 has a proximal end 99 and a distal end 101.

As shown in FIG. 6, shaft 85 defines an interior channel 103 which extends the length of the shaft 85. Fitted within the channel 103 proximate the proximal end 99 is a pair of rotatably mounted pulleys 105. The pulleys are individually identified as pulley 105A and pulley 105B. Pulleys 105 are mounted on a shaft 107, which is oriented horizontally and orthogonally to the longitudinal axis 109 of shaft 85. The shaft 107 is inserted through apertures defined within opposing sidewall panels 86A and 86B of shaft 85. Shaft 107 passes through the pulleys 105, similarly to the construction of pulleys 95 described above. The shaft 107 defines the axis of rotation of the pulleys 105.

Mounted on shaft 85 between ends 99 and 101 is a drive means 109. In the illustrated embodiment, this drive means is shown as an electrically powered winch 111 having a drum 113. Other winches of various configurations are also suitable for use with the invention, e.g., mechanical winches.

Affixed to the drum 113 of winch 111 is a cable 115. This cable is preferably fabricated of a high strength material such as steel. The cable extends from the drum to pulley 105A and passes around that pulley within the annular track of that pulley. The cable then extends to pulley 95A and is directed around that pulley within its circular track. Thereafter, the cable is directed through the hollow channel 87 until reaching pulley 93. The cable 115 passes around the pulley 93 being retained within the annular track of that pulley. Thereafter, cable 115 is directed back through channel 87 until reaching pulley 93B. The cable 115 passes around pulley 93B, being retained within the annular track of that pulley 93B. From pulley 93B, the cable 115 extends to the pulley 95B and passes around that pulley within the track of that pulley. The cable thereafter extends to its free end 117, which is affixed to shaft 85 by a retaining pin 119.

Figure 8:
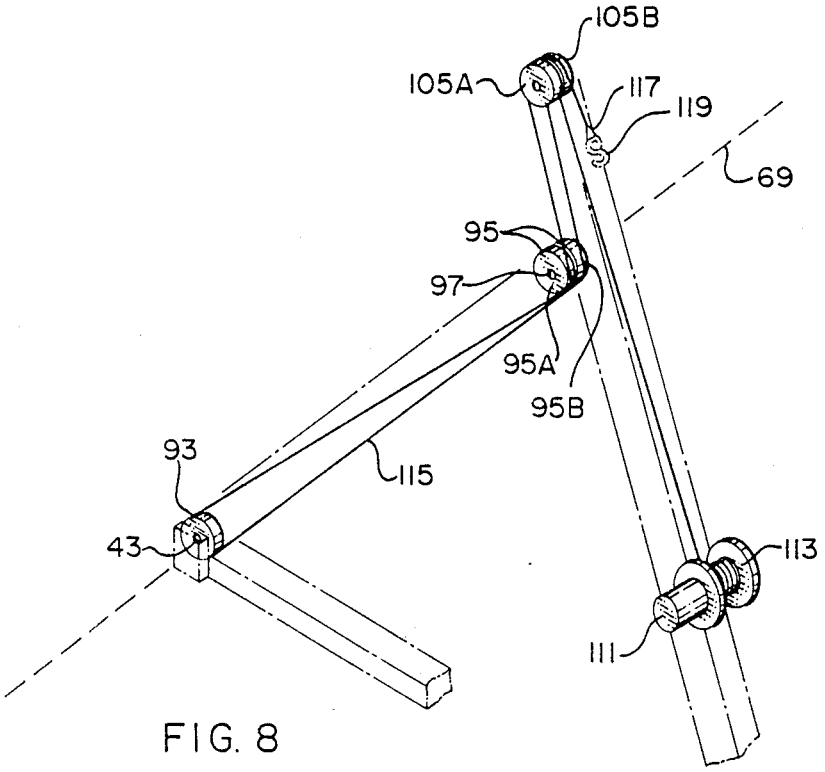
FIG. 8 is a partial perspective view of the cable arrangement of the hoist of the invention. The shafts of the hoist are shown in phantom four purposes of clarity.

FIG. 8 illustrates schematically the cable 115 arrangement with the shafts 21, 37 and 85 being depicted in phantom for purposes of clarity. As shown, the free end 117 of cable 115 may be fitted with an eyelet or rivet which in turn is secured to the retaining pin 119.

Shaft 85 may be composed of two elongate shaft sections, respectively 85A and 85B. These sections are fitted end to end and releasably retained in that orientation by a pair of hinging members 121 and 123. The hinge members 121 and 123 are mounted on opposing faces 125 and 126 of the shaft 85. Hinge member 123 is made disassembable whereby upon its disassembly, the hinge 121 permits the shaft section 85A to h=rotated about the hinge and brought to rest over the top of shaft 37. This construction thereby provides a structure which is collapsible for purposes of ease in shipping and transport.

Hinge 121 includes a first elongate ear 129 which extends outwardly from shaft section 85B, parallel to the longitudinal axis 131 of that section 85B. Ear 129 defines an aperture 133 therein. A corresponding ear 135 extends outwardly from shaft section 85A parallel to the longitudinal axis 139 of section 85A. Ear 135 also defines an aperture 141 therein. Fitted within apertures 141 and 133 is a pivot shaft 143 which forms an axis of rotation for hinge 121. Pivot shaft 143 is preferably fixedly retained within ear apertures 133 and 141.

Figure 12:
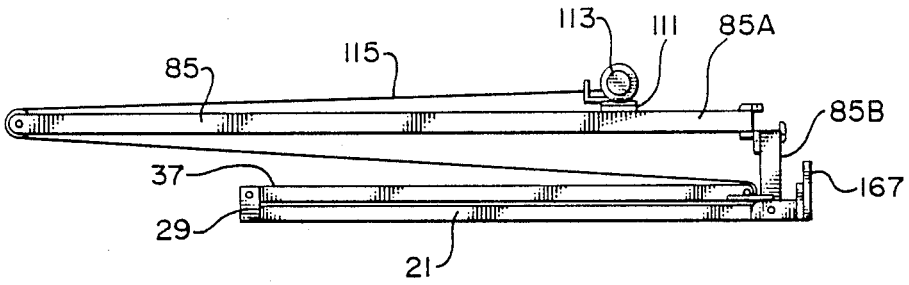
FIG. 12 is a side view of a hoist of this invention shown in its folded-down shipping orientation.

Hinge 123, as shown, includes an elongate ear 145 mounted on shaft section 85B to extend outwardly therefrom parallel to longitudinal axis 131. A pair of elongate ears 147 are spacedly and parallelly mounted on shaft section 85A to extend outwardly and parallel to longitudinal axis 139. The ears 147 define a space therebetween dimensioned to receive ear 145. Each of the ears 147A, 147B and 145 define an aperture therein dimensioned to receive a retaining shaft 151. When the shaft sections 85A and 85B are abutted end to end, as shown in FIGS. 1 and 4, the apertures within ears 147A, 147B and 145 are aligned in register whereby a retaining shaft 151 may be slidably inserted through all of these apertures and lodged therein. In this orientation, the shaft 151 retains the sections 85A and 85B in their end abutting relationship and the shaft sections 85A and 85B form one continuous elongate shaft member. The shaft 151 may be retracted from the apertures in hinge 123 whereby the hinge 123 is disassembled into two elements, i.e., ears 147 and ear 145. In this event, the shaft section 85A is free to rotate about shaft 143. Shaft 85A may be rotated and brought to rest over horizontally oriented shaft 37, as shown in FIG. 12.

In an alternate construction, the hinging arrangement 121 and 123 may be replaced by a sleeve construction wherein shaft 85B defines a hollow channel therein dimensioned to slidably receive shaft 85A. This hollow channel has a sufficient depth to permit enough of shaft 85A to be received within the channel to provide a degree of structural integrity to the overall shaft 85. To disassemble the shaft 85, shaft segment 85A is simply displaced upwardly out of the channel, whereby shaft segments 85A and 85B are separated one from another.

Figure 3:
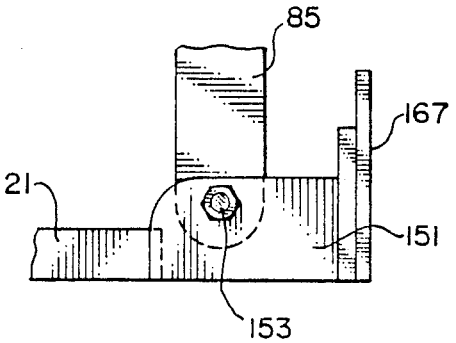
FIG. 3 is a sectional view of the support plate of the hoist.

The distal end 101 of shaft 85 is rotatably mounted to base shaft 21 at the distal end 27 of that shaft 21. As shown to advantage in FIGS. 1 and 3, the distal end 27 of shaft 21 includes a pair of ears 151. The ears 151 are mounted spacedly apart on opposing sidewalls of shaft 21. The ears 151 extend outwardly from the shaft 21 parallel to the longitudinal axis 150 of that shaft 21. The ears 151 are preferably made of metal and may be welded to metal shaft 21. Each ear 151 defines an aperture 153 therein. The apertures 153 are aligned with an elongate channel 161 defined within the distal end 101 of shaft 85. A pivot pin 163 constructed similar to shaft 37 is passed initially through aperture 153A and then through the channel 161. Thereafter the pin passes through aperture 153B. The pin 163 is retained in position by threaded nuts which are threaded into the threaded ends of pin 163. Shaft 85 is free to rotate in a vertical plane about a horizontal axis defined essentially by pin 163.

Mounted on the ends 165 of ears 151 is a support panel 167. This panel is a planar member which is oriented, substantially orthogonal to the longitudinal axis 150 of base shaft 21. Panel 167 includes an abutment edge 169 which extends orthogonal to the bottom of shaft 21 and thereby functions to hinder, if not preclude, a rotation of base shaft 21 about its longitudinal axis 150, as indicated by arrows 171 and 173.

Support panel 167 may be hinged to base shaft 21 whereby the panel may be rotated about a vertical axis to align the plane of the panel parallel with the longitudinal axis 150 of shaft 21. In other constructions the support panel 167 may be composed of two panels which are hinged to base shaft 21 and are adapted to rotate about a vertical axis to either orient the panels parallel to the longitudinal axis 150 in a storage and shipping orientation or alternately to orient the panels orthogonal to that axis such as shown in FIG. 1 in an operational orientation.

Figure 5:
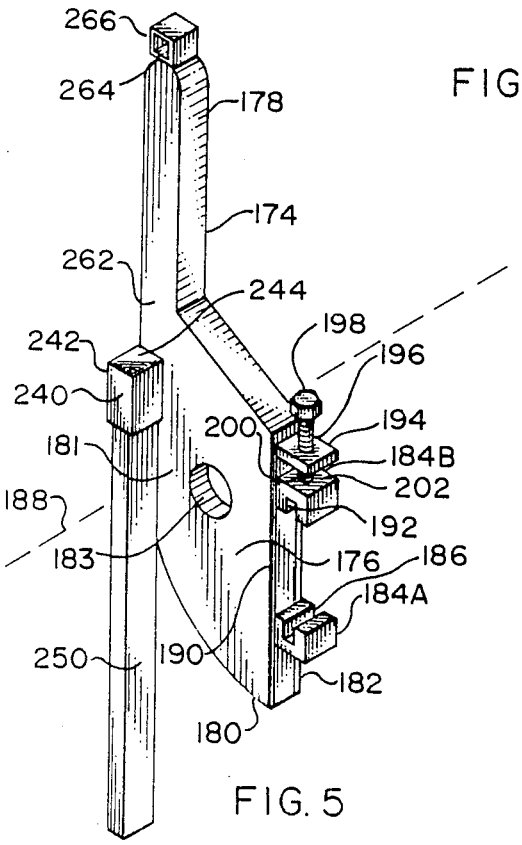
FIG. 5 is an elevated perspective view of a bearer of the invention.

The hoist of the invention is adapted for use in association with a cradle bearer or "tumbler." One such bearer structure 174 is illustrated in FIG. 5. It should be understood that the hoist may equally be used with other cradle bearer structures, e.g., those disclosed in U.S. Pat. No. 3,674,252 (Crabtree) and U.S. Pat. No. 4,594,048 (Sipla). As hereinbefore stated, the specifications of these patents are incorporated herein by reference.

The cradle bearer 174 of FIG. 5 discloses a generally planar structure having a first section 176 and a second section 178. First section 176 includes a perimeter having an arc-shaped edge or region 180. This edge 180 forms an abutment surface which contacts the ground as the cradle rotates in a vertical plane about a generally horizontal axis. The first section includes a planar panel 181 which defines an aperture 183 therein. This aperature is dimensioned to slidably receive and retain support shaft 47. Fitted on the linear vertically positioned edge 182, opposite the edge 180, are a pair of spacedly mounted brackets 184. Bracket 184A is fixedly mounted to edge 182. Bracket 184A defines an elongate slot 186 on its upper face which extends parallel to lateral axis 188. Bracket 184B is mounted to slide reciprocally along edge 182. Bracket 184B is fitted within a track 190 which extends along edge 182. Track 190 precludes bracket 184B from moving laterally, i.e., parallel to axis 188. Bracket 184B defines an elongate slot 192, identical in appearance and orientation to slot 186. Slot 192 is positioned on the bottom surface of bracket 184B. The slots 192 and 186 are positioned opposite and facing one another.

A support bracket 194 extends outwardly from edge 182 and is mounted above bracket 184B. Support bracket 194 precludes any further upward vertical displacement of bracket 184B along track 190. Bracket 184B defines threaded aperture 196 therein which is fitted with a threaded bolt 198. Bolt 198 may be threadedly inserted or retracted from aperture 196 in order to adjust the location of bracket 184B. Bolt 198 adjusts that location by impacting the end 200 of that bolt 198 against the upper face 202 of bracket 184B.

That first section 176 defines an aperture 210 therein which is dimensioned to slidably receive a support bar 47. As shown to advantage in FIGS. 1 and 9, support bar 46 is an elongate, hollow, cylindrical shaft.

Figure 13:
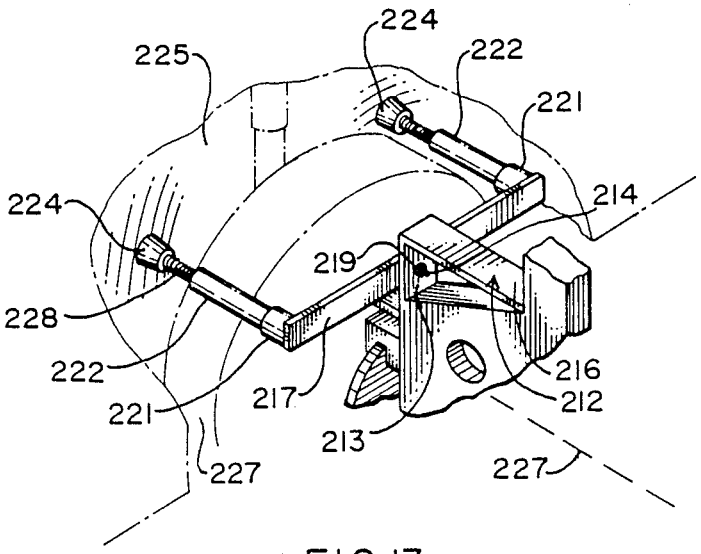
FIG. 13 is a partial elevated perspective of a wheel and hub assembly fitted with an auxiliary support mounted bearer.

The first section 176 may include a supplementary support 212, as shown in FIG. 13. This supplementary support 212 includes a first upright panel 213 having an aperture therein sized to receive a threaded bolt 214. Panel 213 is supported by a second panel 216 which is mounted on first section 176 substantially orthogonal to panel 213.

A bracket arm 217 is connected to supplementary support 212 by bolt 214 which passes through an aperture in the elongate arm 217 and subsequently through the aperture in the panel 213. The bolt 214 is retained in position by a nut 219 which is threadedly inserted over the threaded end of bolt 214.

Mounted on each end 221 of bracket arm 217 is a respective elongate abutment arm 222. Each arm 222 extends outwardly, substantially perpendicular, from the arm 217. The free end of each arm 222 is fitted with a foot 224 which is configured to abut against the wheel well 225 of the vehicle and thus stabilize the wheel 227 against any rotation about axis 226. Each foot 224 is preferably fabricated from a material having a high coefficient of friction, e.g. rubber. This material choice lessens the likelihood that the foot will slide along the surface of the wheel well 225.

In the construction illustrated in FIG. 13, the foot 224 is made adjustable. A threaded shaft 228 is fixedly mounted on the foot 224 to extend outwardly therefrom. This shaft 228 is rotatively inserted into a interiorly threaded recess well defined within the arm 222. The user is able to adjust the location of the foot 224 by either inserting or retracting the shaft 228 into or out of the recess well.

In contrast to former systems, the instant carrier is directed for use with the wheel and tire in place on the wheel hub.

Former bearer structures were adapted for mounting on the hub, with the wheel and tire being removed beforehand.

The first section 176 is mounted to the wheel 227 by a plurality of threaded rods 230. Each of these rods 230 includes an elongate shaft having an interiorly threaded recess well configured within each end 232. The threads in end 232A are configured to be threaded onto the lug bolts 233 which extend outwardly from the wheel 230. Each rod 230 defines a shoulder at a spaced distance from its end 232B.

A circular mounting plate 234 is adapted to receive the rods 230 and form a manually releasable union therewith. The plate 234 defines a plurality of apertures therein which are individually dimensioned to receive a respective end 232B of a rod 230. The apertures are dimensioned to be smaller than the shoulder of each rod such that the shoulder abuts against the face of the plate 234, after the end 232B of the rod has been inserted a sufficient distance into the aperture of the plate 234. After the rod 230 has been so inserted, a bolt 236 is threadedly inserted into the rod recess well on the end 232B. The bolt 236 is inserted sufficiently to bring the head of the bolt into contact with the face of the plate 234 opposite to that face abutting against the shoulder of the rod. The bolt 236 may thus be tightened to sandwich the plate 234 between the head of bolt 236 and the rod shoulder and thereby retain the plate 234 in position.

Figure 10:
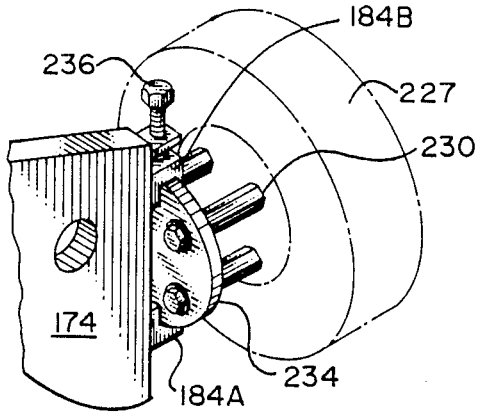
FIG. 10 is a partial elevated perspective view of a wheel and tire of a vehicle shown fitted with a bearer mounting plate.
Figure 11:
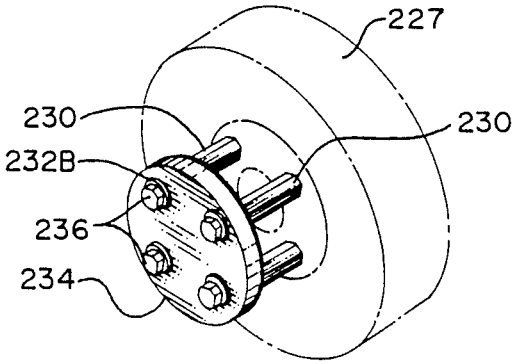
FIG. 11 is an elevated perspective view of a wheel and tire of a vehicle shown fitted with a mounting plate.

Plate 234 is received and manually releasably retained within the pair of slots defined by brackets 184A and 184B. The bolt 198 is tightened down to bring the bracket 184B into a securing position against the plate 234, as shown in FIG. 10.

The first section 176 of the bearer 174 may also include a sleeve bracket 240 which is mounted on the planar face 242 of the first section 176. In preferred embodiments, a sleeve bracket 240 is mounted on each of the opposing planar faces of the first section, i.e., each bearer includes a pair of sleeve brackets 240.

Each sleeve bracket 240 is a generally box-like member, having four planar sidewalls 242 arranged in a quadrilateral configuration. A top planar panel 244 is mounted on the sidewalls 242. The sidewalls 242 and top panel 244 define a hollow structure having a quadrilateral cross-section which remains constant over the length of the bracket. The bracket 240 defines an open-ended channel through its interior which is dimensioned to slidably receive an elongate support shaft 250. Support shaft 250 may be slidably inserted or retracted at will. The channel, and hence the shaft 250, are oriented on the face of the first bearer section 176 such that upon the vehicle reaching a selected sideways tilted orientation, a shaft 250 may be inserted into each bracket 240 to form a support for the vehicle. As shown, the shaft 250 extends outwardly from the bracket 240 parallel and contiguous the ground. Normal forces, as represented by arrows 252, urge the shaft to rotate about the bracket 240 as depicted by torque arrows 254. The normal forces are opposed by an opposite torque resultant from the weight of the vehicle acting on the bracket through the bearer 174. Due to the material composition of the bearer structure 174, these opposite torques are held in equilibrium and the vehicle remains in the selected orientation. In preferred embodiments, one of the brackets 240 is positioned on the face of the bearer such that when the shaft 250 is inserted, the vehicle is retained at a vehicle retention angle 255 equal to approximately 75°. The other bracket 240 which is mounted on the opposing face of the same bracket 240 is oriented to effect a vehicle retention angle of approximately 80°. These angles may be varied by the user by modifying the orientation of the brackets 240 on the bearers 174.

Figure 9:
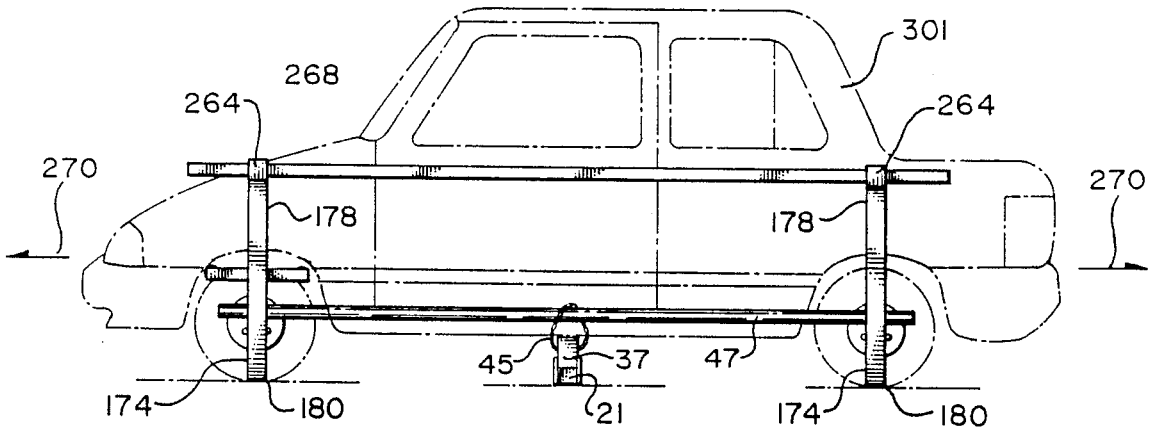
FIG. 9 is a side view of a vehicle (in phantom) shown fitted with a pair of bearers held in position vis-a-vis each other by a tie rod.

The second section 178 of the bearer 174 is depicted as an elongate member which is mounted on the first section to extend outwardly therefrom parallel to the face of the bearer 242. Mounted on the end 262 of the second section 178 is a retaining bracket 264. As shown, this bracket 264 includes four planar panels oriented in a box-like quadrilaterally cross-sectioned configuration. The bracket 264 defines a hollow channel 266 which is open on both ends. The channel 266 is configured to receive and manually releasably retain a tie bar 268. As shown in FIG. 9, tie bar 268 is an elongate shaft which extends between a pair of bearers 174. The tie bar 268 is quadrilateral in cross section. The tie bar 268 may be fitted with a locking means for retaining the tie bar in a fixed relationship with each bearer 174 such that a lateral displacement, i.e., displacement parallel to the arrows of 270, is hindered, if not precluded. Such locking means may include dimensioning the tie bar 268 to have a close tolerance fit within channel 266 whereby a lateral motion would bind the bracket 264 on the rod. Alternately, the bar 268 may be retained to the bracket 264 by a bolt which passes through both members and is retained in position by a locking bolt. As shown in FIG. 9, support shaft 47 extends between the pair of bearers 174, being received and retained within an aperture 183 within each of said bearers 174. The shaft 47 is slidable within the aperture 183 whereby any displacement of that shaft substantially parallel to the longitudinal axis 185 of that shaft 47 does not effect a disruption of the parallel orientation and positioning of those bearers 174 on the vehicle 300.

Operationally, the instant invention is applied by first removing the lug nuts from the lug bolts 233 of the wheels on one side of the vehicle. The cradle bearers are then attached to each wheel. The following description of this attachment is directed to a single bearer. It should be understood that the same process applies to the other bearer 174 or bearers as well. Rods 230 are then threaded onto each of the exposed lug bolts 233. After tightening each of the rods 230 against its respective wheel 227, the plate 234 is positioned over the rods 230 so that the free ends 232B of the rods 230 extend through the apertures in that plate 234. Each bolt 236 is then threaded into a respective recess well in the end of a rod 230, bringing the head of the bolt 236 into abutment against the plate 234. The plate 234 is retained firmly, yet manually releasably between the head of bolt 236 and the shoulder of the rod. The plate 234 is then slid into the opposing slots 186 and 192 defined by brackets 184. The bolt 198 is then threadingly inserted or retracted to position the top bracket 184B into a firm retaining position against the plate 234.

With each bearer being mounted on its respective wheel 227, the tie bar 268 is inserted through retention brackets 264 to obtain the configuration shown in FIG. 9.

The support shaft 47 is likewise inserted apertures within the first sections of the bearers to obtain the orientation shown in FIG. 9.

The auxiliary support arm 217 may be mounted to the bearer positioned on the front wheel of the vehicle. The feet 224 of that support arm are both positioned firmly against the wheel well 225.

The hoist 20 is then positioned beneath the vehicle such that the bottom surface 23 of the base shaft 21 is solidly and firmly planted on level ground. The longitudinal axis 150 of shaft 21 is oriented orthogonal to the longitudinal axis 30° of the vehicle 301. The base shaft 21 is preferably positioned between the front and rear wheels of the vehicle.

The proximal end 25 of base shaft 21 is positioned sufficiently close to the support shaft 47 that the chain 45 may be passed over and around the support shaft 47 and the free ends of that chain linked to form an endless chain.

The contact structure 66 is positioned to abut against the undercarriage of the vehicle 301 in a non-sliding relationship.

Figure 7:
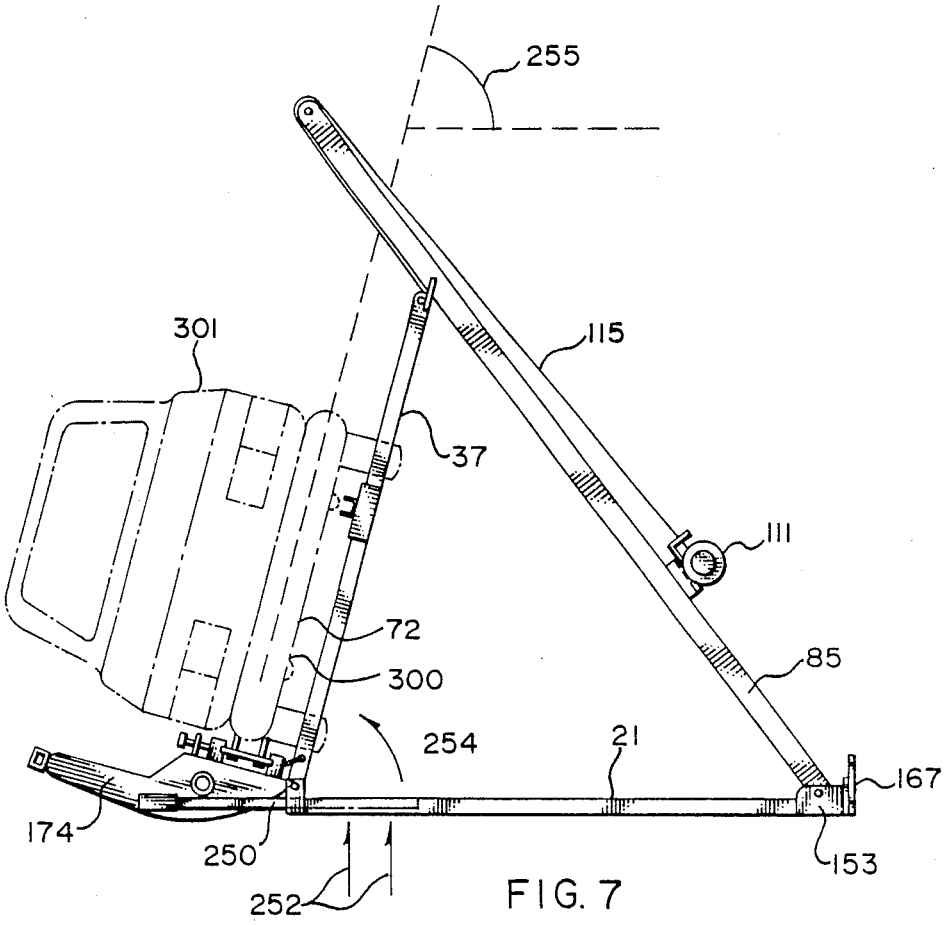
FIG. 7 is a side view of the hoist of the invention shown lifting and tilting a vehicle.

The mast shaft 85 is initially positioned in an upright orientation, such as that shown in FIG. 4. The winch 111 is then activated to wrap the cable 115 around drum 113. As the cable is successively wrapped around the drum 133, the lift shaft 37 begins to pivot around pivot axis 43A. As a result, the distal end of lift shaft 37 begins to travel upward along the length (height) of mast shaft 85. The mast shaft 85 also begins to rotate about its axis of rotation 163A, which results in the proximal end 99 of shaft 85 traveling toward the ground. As the hoist operates, the orientation of the shaft members 21, 37 and 85 begin to adopt a triangular-like configuration. As lift shaft 32 continues to rotate, it lifts the non-bearer fitted side of the vehicle 301, as shown in FIG. 7. As the lifting action progresses, the vehicle is turned on its edge, thereby bringing the edge 180 of the bearer into a rolling-type contact with the ground. Upon the vehicle reaching a desired angular orientation, the shafts 250 are inserted into brackets 240, as shown in FIG. 7. The vehicle is then in an orientation adapted for the mechanic to service the undercarriage. The hoist may then be removed by unclasping chain 45 and moving the hoist out of the area. Alternately, the hoist may be maintained in position.

To lower the vehicle 301, the shafts 250 are removed and the winch 111 direction is reversed. As the cable is let off of the drum 113, the vehicle 301 descends along the same path it followed to reach its raised and tilted orientation.

It is to be understood that the embodiments herein described are merely illustrative of the principles of the invention. References herein to the details of the illustrated embodiment is not intended to limit the scope of the claims which themselves recite those features regarded as significant to the invention.

I claim:

1. A device for lifting and tilting a vehicle sideways, said device comprising:

a first elongate shaft having a first end, a second end, and a first longitudinal axis;

a planar support panel mounted on said first end of said first shaft, orthogonally to said first longitudinal axis;

a first pair of upstanding first ears mounted spacedly apart from one another on said second end of said first shaft, each of said first ears defining a first opening therein;

a second elongate shaft having a third end, said third end being pivotally mounted between said first pair of ears by a first pin which extends through said first ear openings and a first channel defined within said second shaft, said second shaft having a second longitudinal axis;

a pair of upstanding second ears mounted on said first shaft spacedly apart from one another proximate said first end, each of said second ears defining a second opening therein;

a third elongate shaft having a fifth end which is mounted pivotedly to said first shaft between said second ears by a second pin which extends through each of said second openings and further extends through a second channel defined in said third elongate shaft, said third shaft having a sixth end;

a pair of third ears spacedly mounted, apart from one another on said fourth end of said second shaft, said third ears extending outwardly from said second shaft, parallelly to said second longitudinal axis, defining a "U"-shaped channel, said third shaft being slidably positioned between said third ears within said "U"-shaped channel;

a first pulley mounted rotatably on a sixth end of said third shaft;

a second pulley mounted rotatably on said sixth end of said third shaft;

a third pulley mounted rotatably on said fourth end of said second shaft;

a fourth pulley mounted rotatably on said fourth end of said second shaft;

a fifth pulley mounted on said third end of said second shaft;

a winch mounted on said third shaft;

a cable having a first end and a second end, said first end being mounted on said winch, said cable extending from said winch to and over said first pulley, said cable then extending to and over said third pulley, said cable then extending to and over said fifth pulley, said cable then extending to and over said fourth pulley, said cable then extending to and over said second pulley, said second end of said cable being mounted to said third shaft;

wherein said device is positionable beneath a vehicle such that said second shaft abuts against a bottom surface of said vehicle;

wherein a rolling up of said cable onto said winch effects a rotation of said second shaft about its pivotedly mounted third end, said rotation, due to said second shaft's abutment against said vehicle bottom surface, affecting a sideways lifting of said vehicle.

2. The device according to claim 1 wherein said third shaft includes a first shaft segment and a second shaft segment, said first shaft segment being detachably connected to said second shaft segment by a first connecting means, said connecting means comprising:

a first pivoting hinge having a first leaf and a second leaf pivotedly connected to one another by a third pivot pin, said first leaf being mounted on said first shaft segment, said second leaf being mounted on said second shaft segment, wherein said first leaf is pivotable with respect to said second leaf;

a second pivoting hinge having a third leaf and a fourth leaf pivotedly connected to one another by a fourth pivot pin, said third leaf being mounted on said first shaft segment, said fourth leaf being mounted on said second shaft segment, wherein said third leaf is pivotable with respect to said fourth leaf, said third pivot pin being removable from said hinge, said fourth pivot pin removal affecting a separation of said third leaf from said fourth leaf;

wherein said first hinge and said second hinge are mounted on said first shaft segment and said second shaft segment to retain said segments in a colinear relationship; and wherein a removal of said fourth pivot pin permits a pivoting rotative motion of said first shaft segment about said first hinge, said rotative motion facilitating a placement of said first shaft segment atop said second shaft defining thereby a collapsible device suitable for easy shipment.

3. The device of claim 1 further comprising:

a pair of bearers, each said bearers including a first section having an arcuately shaped bearing surface and an elongate section mounted on said first section and extending outwardly therefrom;

a pair of mounting means, one of said mounting means associated with each of said bearers for releasably connecting each of said bearers to a hub of said vehicle;

a tie rod associated with said bearers for releasably connecting together each of said bearers and maintaining said bearers a spaced distance apart, said distance being equivalent to a wheel base of said vehicle;

a third connection means for connecting said second shaft to said bearers, said third connection means substantially retarding any sliding motion of said first shaft relative to said vehicle; and wherein a rotation of said second shaft about its pivot effects a sideways lifting of said vehicle, resulting in said vehicle being rested upon said bearers in a sideways inclined position.

4. The device according to claim 3 wherein said mounting means comprises:

a plurality of elongate rods, each of said rods having a proximal end and a distal end, each said proximal end having a set of interior threads configured to mechanically cooperate with a lug bolt of said vehicle, each said distal end of said rod having a set of interior threads configured therein, each said rod having a shoulder positioned proximate its said distal end;

a plate having a plurality of apertures therein, said apertures releasably receiving and retaining said distal ends of said rods, said plate abutting against each said shoulder of each said rod;

a plurality of bolts, each bolt having a head and a threaded shaft extending from said head, each said threaded shaft being threadingly inserted into said distal end set of threads such that said head is brought into abutment against said plate, said plate being retained releasably between each said shoulder and said head, each said plate being releasably received and retained within slots defined within a respective said bearer, wherein said bearer is releasably retained in an outwardly extending orientation relative to said hub.

5. The device according to claim 4 wherein said fourth connection means is an elongate chain having a seventh end and an eighth end, said chain extending through an opening in said second shaft and around said fourth shaft, said chain having means of releasably joining together said chain's seventh end and eighth end to form an endless loop.

6. The device according to claim 4 wherein said fourth connection means is a hook mounted on said second shaft, said hook being releasably connected to said fourth shaft.

7. The device according to claim 3 wherein said third connection means comprises:

a fourth elongate shaft associated with said bearers, said fourth shaft being slidably mounted within an aperture defined within each said bearer and extending between said bearers;

a fourth connection means mounted on said second shaft for releasably connecting said first shaft to said fourth shaft.

8. The device according to claim 3 wherein said third connection means comprises an elongate chain having a ninth end and a tenth end, said chain extending through an opening in said first shaft and around said tie rod, said chain having means of releasably joining together said chain's ninth end and said chain's tenth end.

9. The device according to claim 3 wherein said third connection means is a hook mounted on said first shaft, said hook being releasably connected to said fourth shaft.

10. A device for lifting and tilting a vehicle sideways, said device comprising:

a first shaft having a first end and a second end;

a second shaft having a third end and a fourth end, said third end of said second shaft being pivotedly connected to said first end of said first shaft, said second shaft being positionable below an undercarriage of a vehicle so as to abut against said undercarriage;

a third shaft having a fifth end and a sixth end, said fifth end of said third shaft being pivotedly connected to said second end of said first shaft, said third shaft being uprightly extendable from said first shaft;

a guiding means associated with said second shaft for aligning and guiding said third end of said second shaft reciprocally along the length of said third shaft;

a first pulley mounted on said sixth end of said third shaft;

a second pulley mounted on said sixth end of said third shaft;

a third pulley mounted on said fourth end of said second shaft;

a fourth pulley mounted on said fourth end of said second shaft;

a fifth pulley mounted on said third end of said second shaft;

a cable having a proximal end and a distal end, said first end being fixed to said third shaft and extending over said second pulley to and over said third pulley, said cable then extending to and over said fifth pulley, said cable then extending to and over said third pulley and then to and over said first pulley;

a drive means mounted on said third shaft for displacing said cable over said pulleys, said second end of said cable being mounted to said drive means;

wherein said drive means is capable of drawing said cable towards said drive means, thereby effecting a rotation of said second shaft about its pivoted third end, said rotation effecting a vertical displacement of said fourth end of said second shaft, said rotation effecting a sideways lifting and tilting of a vehicle under which said second shaft has been positioned.

11. The device according to claim 10 wherein said second shaft includes a first connecting means for connecting said second shaft to a bearer means for tilting and retaining a vehicle in a tilted orientation.

* * * * *